United States Patent [19]

Lilley

[11] 4,123,793

[45] Oct. 31, 1978

[54] LAMP REFLECTORS

[75] Inventor: John Lilley, West Midlands, England

[73] Assignee: Lucas Industries Limited, Birmingham, England

[21] Appl. No.: 734,296

[22] Filed: Oct. 20, 1976

[51] Int. Cl.[2] ..... F21V 7/00

[52] U.S. Cl. ..... 362/350; 362/359; 260/37 R; 260/39 SB; 428/325

[58] Field of Search ..... 362/347, 350, 359; 260/37 R, 39 SB, 40 P; 428/325

[56] References Cited

U.S. PATENT DOCUMENTS

| | | | |
|---|---|---|---|
| 1,285,901 | 11/1918 | Bausch et al. | 362/347 |
| 2,307,574 | 1/1943 | Cunningham | 362/347 |
| 3,562,370 | 2/1971 | Shannon | 260/39 SB X |
| 3,624,021 | 11/1971 | Barba | 260/39 SB X |
| 3,787,191 | 1/1974 | Duncan | 428/325 X |
| 3,991,006 | 11/1976 | Chandler | 260/40 R |
| 4,060,663 | 11/1977 | Merz et al. | 428/325 X |

*Primary Examiner*—Peter A. Nelson
*Attorney, Agent, or Firm*—Holman & Stern

[57] ABSTRACT

A lamp reflector comprises a dished body having a reflective coating on an inner surface thereof. The dished body is formed of a cured, low profile polyester moulding composition containing glass fiber and a compatible, internal lubricant chemically bonded to a filler.

10 Claims, 1 Drawing Figure

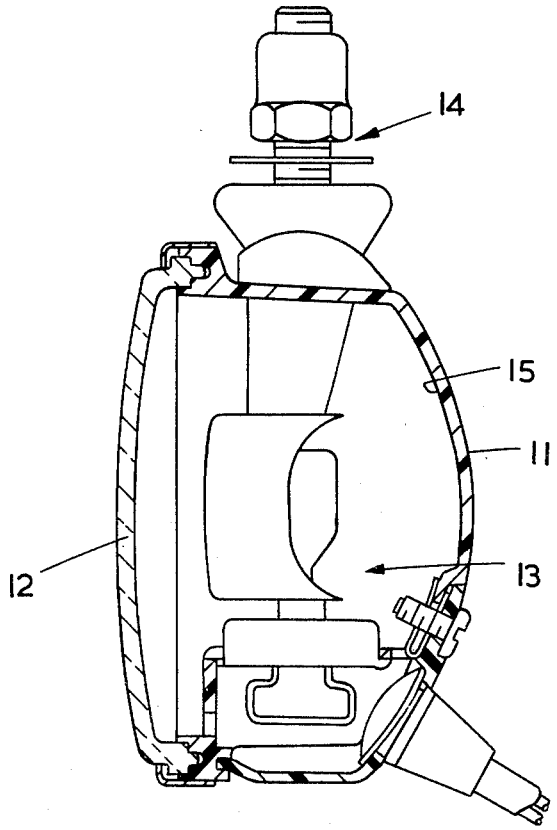
14
15
11
12
13

LAMP REFLECTORS

This invention relates to lamp reflectors particularly, but not exclusively, for use in motor vehicle headlamps and fog lamps.

A lamp reflector, according to the invention, comprises a dished body having a reflective coating on an inner surface thereof, said dished body being formed of a cured, low profile polyester moulding composition containing glass fibre and a compatible, internal lubricant chemically bonded to a filler.

Preferably, said composition contains between 10% and 25% by weight of glass fibre.

Preferably, said composition contains between 50% and 65% by weight of said filler.

Preferably, the polyester moulding composition is one which has been catalysed with an aliphatic peroxy compound, for example tertiary butyl peroctoate.

It is known to produce the dished body of a lamp reflector by curing a low profile polyester moulding composition containing glass fibre and a fatty acid-based lubricant. Applicants have, however, found by experimentation that the conventional fatty acid-based lubricants used for this purpose, which normally contain between 13 and 23 carbon atoms (for example zinc stearate and calcium stearate) cause fogging of the reflective surface due to the fact that the lubricant vaporises and then condenses on the reflective surface at the high temperature experienced during use of the reflector in conjunction with high intensity bulbs. It has now been found that this problem can be successfully overcome, even when the lubricant is based on a fatty acid, provided the lubricant is chemically bonded to a filler.

Applicants have also found that the conventional catalyst of benzoyl peroxide used with known polyester moulding compositions tends to produce a deposit of benzoic acid on the respective surface, which problem can be overcome by use of an aliphatic peroxy catalyst, such as tertiary butyl peroctoate.

The accompanying drawing is a sectional view of a motor vehicle fog lamp incorporating a reflector according to one example of the present invention.

Referring to the drawing, the fog lamp includes a reflector body 11 of dished shape which is closed by a lens element 12 and houses a bulb assembly 13. The body 11 has an internal surface 15 upon which there is provided a reflective coating in the form of a vacuum deposited aluminium film. The lamp also includes a mounting bracket 14 provided on the body 11 to enable the lamp to be mounted, in use, on a motor vehicle.

The body 11 is produced from a low profile polyester moulding composition produced by mixing 0.5 parts by weight of tertiary butyl peroctoate, 20 parts weight of a styrene solution of a unsaturated polyester, 15 parts by weight of 0.25 length chopped glass fibres, and 59 parts by weight of Britomya BSH as sold by Plastichem Ltd., England (a calcium stearate lubricant chemically bonded as a surface coating to a calcium carbonate filler), 4 parts by weight of polypropylene adipate and 1.5 parts by weight of finely divided polystyrene. Conveniently the styrene solution of the unsaturated polyester and the polypropylene adipate are introduced in the form of a mixture supplied by B.P. Chemicals (International) Limited as Cellobond A711/22, an inhibitor (e.g. Butylated hydroxy toluene) preferably being added to the mixture to improve its shelf life.

The moulding composition, after mixing to disperse the glass fibres, is introduced into a suitably shaped mould and the mould is then closed and heated to cure the moulding composition and thereby produce the required body 11. Preferably, the moulding composition is introduced into the mould by an injection process since, if all entrapped air is removed from the moulding composition prior to injection, it is found that the surface finish of the final body 11 is improved. This is conveniently achieved by arranging that the moulding composition is fed to the injection device by a hopper which is connected to a vacuum source so as to ensure that the space above the moulding composition is evacuated whereby any entrapped air is drawn out of the moulding composition before injection. A suitable machine for performing such an injection process is that manufactured by Georg Seidle K.G. Munich as type F.P.A. 1 BX-A.

Preferably, curing of the moulding composition is effected by heating the mould to between 270° and 330° F. The actual time of curing depends upon the thickness of the body to be produced and varies between 0.5 and 3 minutes. During curing, the shrinkage of the moulding composition is found to be insignificant and, on removal from the mould, the body 11 is found to have a surface free of distoration and with high gloss.

To complete the reflector, the inner surface 15 of the body 11 is rendered reflective by initially applying a base lacquer to the surface 15 and then depositing the aluminium film on top of the base lacquer. The base lacquer is arranged so as to adhere to the surface 15 of the body 11 and also to adhere to the aluminium film and conveniently is a polyester. Alternatively, the base lacquer can be an epoxy, an acrylic or an alkyd resin. If required, more than one base lacquer can be applied to the surface 15 before deposition of the aluminium film, and in some cases, it may be preferable to apply a primer to the surface 15 before application of the base lacquer. There may also be provided a top coat of the lacquer over the aluminium film.

It is found that when a lamp incorporating the reflector described above is used with a high intensity bulb, there is substantially no tendency for fogging of the reflective, aluminium film to occur even at working temperatures as high as 150° to 170° C.

I claim:

1. A lamp reflector comprising a dished body having a reflective coating on an inner surface thereof, said dished body being formed of a cured, low profile polyester moulding composition containing glass fibre and an, internal lubricant chemically bonded to a filler.

2. A reflector as claimed in claim 1 wherein said composition contains between 10% and 25% by weight of glass fibre.

3. A reflector as claimed in claim 1 wherein said composition contains between 50% and 65% by weight of said filler.

4. A reflector as claimed in claim 1 wherein the polyester moulding composition is catalysed by an aliphatic peroxy compound.

5. A reflector as claimed in claim 4 wherein said aliphatic peroxy compound is tertiary butyl peroctoate.

6. A reflector as claimed in claim 1 wherein said reflective coating is aluminium.

7. A reflector as claimed in claim 1 wherein at least one layer of base lacquer is interposed between said body and the reflective coating, said base lacquer adhering to said body and said reflective coating.

8. A reflector as claimed in claim 7, wherein said base lacquer is selected from the group consisting of a polyester, an epoxy, an acrylic or an alkyd resin.

9. A motor vehicle headlamp including a lamp reflector as claimed in claim 1.

10. A motor vehicle fog lamp including a lamp reflector as claimed in claim 1.

* * * * *